United States Patent [19]

Flake

[11] Patent Number: 4,543,196

[45] Date of Patent: Sep. 24, 1985

[54] METHOD FOR MAKING GREASE FROM RECLAIMED OIL

[75] Inventor: Clark J. Flake, Trenton, Ohio

[73] Assignee: Armco, Middletown, Ohio

[21] Appl. No.: 618,523

[22] Filed: Jun. 8, 1984

[51] Int. Cl.[4] ..... C10M 1/24; C10M 3/18; C10M 5/14; C10M 7/20

[52] U.S. Cl. ..... 252/35; 252/41

[58] Field of Search ..... 252/35, 41

[56] References Cited

U.S. PATENT DOCUMENTS

| | | | |
|---|---|---|---|
| 2,782,165 | 2/1957 | Peterson et al. | 252/32 |
| 2,806,868 | 9/1957 | Kovacs | 260/412.5 |
| 2,807,531 | 9/1957 | Kovacs | 260/412.5 |
| 3,471,533 | 10/1969 | Kovacs | 260/412.5 |
| 3,591,505 | 7/1971 | Polishuk | 252/35 |
| 3,663,726 | 5/1972 | Waring | 252/35 |

OTHER PUBLICATIONS

*McGraw-Hill Encyclopedia of Science and Technology;* "Fat and Oil, Nonedible"; pp. 203–204.

*Primary Examiner*—John F. Niebling

*Attorney, Agent, or Firm*—Roylance, Abrams, Berdo & Goodman

[57] ABSTRACT

Oil reclaimed from cold mill rolling processes, is thoroughly mixed with at least one soap-forming ingredient, which reacts upon mixing with fats or fatty acids contained in the reclaimed oil to form a soap in situ. The soap in turn thickens the oil into a grease.

22 Claims, No Drawings

METHOD FOR MAKING GREASE FROM RECLAIMED OIL

BACKGROUND OF THE INVENTION

For years, greases have been prepared by reacting fats and fatty acids with various metal compounds to produce a soap, which is thereafter used to thicken a quantity of oil into a grease. Alternatively, grease manufacture may start by dissolving fats or fatty acids in oil. These fats are saponified in situ to form soap which thickens the oil to form a grease.

There are numerous patents which disclose grease making methods in detail. Among these are U.S. Pat. Nos. 2,714,092, 2,915,470, 2,980,612, 3,313,729, 3,639,236, 3,776,846, 3,856,688, 3,864,367, 4,280,917, 4,297,227, and 4,358,384.

Naturally, the cost of the grease is dependent upon the cost of the ingredients involved, i.e. the oil, fats and fatty acids, metallic compounds, and other ingredients required to make the grease and to enhance its properties. Therefore, a method which would reduce or eliminate the need to purchase any of the above-mentioned ingredients would be economically advantageous and commercially desirable.

SUMMARY OF THE INVENTION

It has now been discovered that reclaimed cold mill rolling oil contains sufficient amounts of fats and fatty acids to supply part or all of the soap base requirement for making grease. Cold mill rolling oil is a mixture of mineral oil and fats from either animal or vegetable sources.

This invention provides a two-fold economic advantage. First, the fats and fatty acids present in the reclaimed oil replace those which must be purchased for use in the grease formulation. Second, the use of reclaimed oil reduces the need for virgin oil which also must be purchased.

In accordance with the present invention, reclaimed cold mill rolling oil which contains fats and/or fatty acids is thoroughly mixed with at least one soap-forming ingredient, which reacts upon mixing with said fat or fatty acid to form a soap is situ. The soap in turn thickens the oil into a grease. Additional ingredients may be added to provide desired properties to the grease.

Also, in accordance with this invention, additional fats or fatty acids may be added to either the reclaimed oil, or to the reaction mixture in order to maintain the grease consistency. Likewise, additional base oil may be added in cases where the fat or fatty acid content is higher than desirable.

In a preferred embodiment, the reclaimed oil is mixed and reacted with an aluminum organic complex and benzoic acid to form an aluminum complex grease. The preferred aluminum organic complexes are aluminum tri-isopropoxide (API), or the cyclic trimer, tri-oxy aluminum triisopropoxide. The cyclic trimer is available from Joseph Ayers Inc. under the tradename Kolate 7013.

In another embodiment, the reclaimed oil is mixed and reacted with lithium hydroxide to form a lithium grease.

DETAILED DESCRIPTION OF THE INVENTION

Reclaimed oils recovered from cold mill rolling processes contain fats and fatty acids necessary to form the soaps needed to make grease. While there is no requirement with respect to the percentage of fats or fatty acids in the reclaimed oil, the preferred range is from about four percent (4%) to about 30 percent (30%) by weight.

Because unreacted fatty acids have harmful effects on the quality of grease, it is necessary to achieve the proper balance of reactants to assure complete reaction of the fatty acids present in the reclaimed oil. It appears that excess fatty acids interchange with the benzoic acid causing a softening of the grease. Additional soaps are then required to reduce this effect. Also, if the fatty acids are not fully utilized, some of the raw material cost benefits are wasted. Consequently, all the free fatty acids should be utilized by proper balancing of the formulation.

With the above in mind, a grease can be formulated to use only the free fatty acids present in the reclaimed oil, or this oil can be used to obtain a certain base oil viscosity thereby necessitating the addition of fatty acids. A comparison of such formulations is shown in Table 1. All percentages are by weight.

TABLE 1

Formulations Of Aluminum Complex Grease From Reclaimed Oil

| | Batch No. | |
|---|---|---|
| | 33 | 34 |
| % Reclaimed Oil | 49.0 | 24.1 |
| % 3000 SUS Black Oil | 40.8 | 65.1 |
| Base Oil Vis. in SUS | 900 | 1300 |
| % Soap | 5.5 | 4.6 |
| % Fatty acid added | — | 1.2 |
| % Benzoic acid | 1.6 | 1.3 |
| % Kolate 7013[1] | 2.7 | 2.25 |
| % Microthene[2] | 2 | 2 |
| % Van Lube 71[3] | 2.5 | 2.5 |
| % NaSul LS[4] | 1.5 | 1.5 |

[1]Physical and Chemical Data on "Kolate 7013": Aluminum content, percent by weight, 12.5; Molecular weight, 306; Tri-oxy aluminum tri-isopropoxide, percent by weight, 55; Naphthenic mineral oil (82 US at 100° F.), weight percent, 45.
[2]A polyethylene used to improve water spray-off characteristics.
[3]Lead diamyldithiocarbamate.
[4]A high molecular weight synthetic sulfonate used as a corrosion inhibitor.

The base oil used to make Batch No. 33 contains just enough fatty acids to react with the benzoic acid and Kolate 7013. However, this produced a base oil with a viscosity of only 900 SUS, so a total of 5.5% soap is required to achieve the desired hardness. If, as in Batch No. 34, the viscosity is adjusted to the optimum of 1300 SUS, not enough fatty acids are present in the oil. Additional stearic acid must be added. Both formulations result in greases which have similar properties. With several base oils available, one can use only the fatty acids present and then with the other minerals oils, adjust the resulting base oil viscosity to that desired.

Properties of the grease produced by this technique can be improved with the use of different types of additives (Table 2).

TABLE 2

Effect Of Additives And Paper On Water Spray-Off

| Batch | Description | Penetration | % Water Spray-Off |
|---|---|---|---|
| 36 | Van Lube 71 | — | 96 |
| 37 | Van Lube 72[5] | 322 | 87 |
| 49 | Van Lube 72 + | 323 | 71 |

TABLE 2-continued

Effect Of Additives And Paper On Water Spray-Off

| Batch | Description | Penetration | % Water Spray-Off |
|---|---|---|---|
| 51A | 1% black Kraft paper Van Lube 72 + 2% white paper before milling | 330 | 73 |

[5]Van Lube 71 plus lead naphthenate

In Batch No. 36, Van Lube 71 was used as an extreme pressure additive. Water spray-off characteristics are quite poor at 96%. In Batch No. 37, Van Lube 72 was used for the same purpose and the water spray-off was improved slightly to 87%. With the addition of paper fibers (Batch Nos. 49 and 51A), the spray-off was improved to the mid-70's.

The pysical properties of greases are strongly affected by different components of the formulation. The work stability of the grease is affected by the amount of soap used, by the molar ratios of these soaps, and by the viscosity and other characteristics of the base oil. The mobility (low temperature flow characteristics) is affected by the viscosity index and pour point of the base oil as well as by the amount of soap in the formulation. The water spray-off properties are affected by the characteristics of the base oil and the properties of the gel formed. Extreme pressure properties and anti-wear properties are affected by the additives used and the base oil composition. The penetration of the grease is affected by the base oil viscosity, and by the amount, the chemical composition, and the structure of the soap.

Many of these properties are related. For example, the penetration of a grease is related to the water spray-off characteristics; most number two (#2) greases have very good water spray-off properties and all number zero (#0) greases have poor water spray-off properties.

Mobility and water spray-off characteristics of grease are both related to base oil viscosities. However, in this case, there is an inverse relationship. A high base oil viscosity improves water spray-off, but degrades mobility. Asphalt added to a production batch of grease reduces its mobility noticeably, and increasing the viscosity of the base oil from 1300 SUS to 1500 SUS reduces the mobility by more than 50%. Cellulose additions also reduce the mobility, but not by a large amount.

Grease compositions within the present invention comprise the reaction product of a metallic base, and saponifiable materials found in the reclaimed oil, plus those saponifiable materials which may be added to the reclaimed oil.

Suitable saponifiable materials which may be found in the reclaimed oil, or which may be added to the reclaimed oil or reaction mixture, comprise higher fatty acids containing from about 12 to 32 carbon atoms per molecule and hydroxy substituted higher fatty acids, their glycerides and other esters and mixtures thereof. Also within contemplation of the present invention are saponifiable materials with lower fatty acid materials, such as fatty acids containing from one to about six carbon atoms per molecule, their glycerides, and other esters. Also, intermediate molecular weight fatty acid materials may be employed in admixture with the higher fatty acid materials in varying amounts.

The metallic bases employed in saponification may be any suitable basic reacting compound such as, for example, the oxides, hydroxides, or carbonates of sodium, lithium, potassium, calcium, barium, magnesium, zinc, cobalt, manganese, aluminum, lead, etc.

Any other oil which is added to maintain consistency may be chosen from those normally used in grease manufacture. These include the conventional mineral lubricating oils, synthetic oils obtained by various refining processes such as cracking and polymerization, and other synthetic oleaginous compounds such as high molecular weight ethers and esters.

Reaction times and conditions for making greases are well documented in United States patents including those listed above. The process and formulations for making aluminium complex greases are explained in a paper by H. W. Kruschwitz of Joseph J. Ayers Inc., *The Development of Formulations for Aluminum Complex Thickener Systems,* NLGI Spokesman, May, 1976, pages 51–59.

The following examples are illustrative of this invention.

EXAMPLE 1

In this case, the sample of reclaimed cold mill rolling oil had the following characteristics:

Saponification No. 40.6

Acid No. 15.4

Viscosity 50.3 cSt at 40° C.

The reclaimed oil (391.9 grams) and 8.0 grams of black paper were heated to 210° F. Benzoic acid (12.5 grams) was added, and after mixing thoroughly, 21.5 grams of Kolate 7013 were added to the reaction mixture. The batch was heated to about 385° F. and 16.0 grams of Microthene were added. The mixture was then allowed to cool to 150° F., at which time 28.0 grams of Van Lube 72 and 120 grams of 3,000 SUS black oil were added.

The resulting grease had a penetration of 323 after milling. The water spray-off was 72%, and the resulting base oil viscosity was 430 SUS.

EXAMPLE 2

The reclaimed oil described in Example 1 (373.9 grams) was mixed with 340.7 grams of 3,000 SUS black oil and 8.0 grams of white paper. This mixture was heated to 210° F. at which time 12.5 grams of benzoic acid were added. After the benzoic acid was dissolved, 21.8 grams of Kolate 7013 were added and the reaction proceeded. The temperature of the batch was increased to about 385° F. at which time 16.0 grams of Microthene were added. The batch was allowed to cool to 150° F. and 28.0 grams of Van Lube 72 were added.

The batch of grease had a penetration of 323.

EXAMPLE 3

A lithium grease was prepared by dissolving 3.5 grams of lithium hydroxide in 30 ml. of water. The reclaimed oil described in Example 1 (200 grams) was then added. The base reacted with the free fatty acid immediately and continued to react with the fats found in the reclaimed oil. The batch was heated to 210° F. to remove the excess water.

What is claimed is:

1. A method for making lubricating grease comprising the steps of:

(A) combining a base oil having a minimum viscosity of 430 SUS and including at least one reclaimed cold mill rolling oil, which upon reclamation contains from four percent to thirty percent by weight of a saponifiable compound selected from the group consisting of at least one fat and/or fatty acid, and at least one soap-forming compound which reacts with said saponifiable compound to form a soap, and (B) thoroughly mixing the mixture of said reclaimed oil and said soap-forming compound, whereby a soap is formed in situ, said soap causing said reclaimed oil to thicken into a grease.

2. A method according to claim 1 wherein said soap-forming compound comprises an aluminum-containing compound and benzoic acid.

3. A method according to claim 2 wherein said aluminum-containing compound comprises aluminum tri-isopropoxide.

4. A method according to claim 2 wherein said aluminum-containing compound comprises tri-oxy aluminum-isopropoxide.

5. A method according to claim 1 wherein a quantity of at least one additional saponifiable compound is added to said reclaimed oil.

6. A method according to claim 1 wherein a quantity of at least one additional saponifiable compound is added to said mixture.

7. A method according to claim 1 wherein said soap-forming compound comprises lithium hydroxide.

8. A method according to claim 1 wherein a quantity of at least one additional oil is added to said reclaimed oil.

9. A method according to claim 1 wherein a quantity of at least one additional oil is added to said mixture.

10. A method for making lubricating grease comprising the steps of:

(A) combining a base oil having a minimum viscosity of 430 SUS and including at least one reclaimed cold mill rolling oil, which upon reclamation contains from four percent to thirty percent by weight of a saponifiable compound selected from the group consisting of at least one fat or fatty acid, and at least one soap-forming compound which reacts with said saponifiable compound to form a soap.

(B) thoroughly mixing the mixture of said reclaimed oil and said soap-forming compound, whereby a soap is formed in situ, said soap causing said reclaimed oil to thicken into a grease, and (C) thereafter separating said grease from said mixture.

11. A method according to claim 10 wherein said soap-forming compound comprises an aluminum-containing compound and benzoic acid.

12. A method according to claim 11 wherein said aluminum-containing compound comprises aluminum tri-isopropoxide.

13. A method according to claim 11 wherein said aluminum-containing compound comprises tri-oxy aluminum-isopropoxide.

14. A method according to claim 10 wherein a quantity of at least one additional saponifiable compound is added to said reclaimed oil.

15. A method according to claim 10 wherein a quantity of at least one additional saponifiable compound is added to said mixture.

16. A method according to claim 10 wherein said soap-forming compound comprises lithium hydroxide.

17. A method as defined in claim 1 wherein paper fibers are added to said grease.

18. A method as defined in claim 10 wherein paper fibers are added to said grease.

19. A method as defined in claim 1 wherein said base oil has a minimum viscosity of 900 SUS.

20. A method as defined in claim 10 wherein said base oil has minimum viscosity of 900 SUS.

21. A method according to claim 2 wherein said benzoic acid and aluminum-containing compound are present in an amount sufficient to react with all of the fatty acids present.

22. A method according to claim 20 wherein said benzoic acid and aluminum-containing compound are present in an amount sufficient to react with all of the fatty acids present.

* * * * *